US006283566B1

(12) United States Patent
Doces

(10) Patent No.: US 6,283,566 B1
(45) Date of Patent: Sep. 4, 2001

(54) PORTABLE STEMMED GLASS/CONTAINER RETENTION RACK AND SERVING TRAY

(76) Inventor: G. John Doces, 4432 - 55th NE., Seattle, WA (US) 98105

( * ) Notice: Subject to any disclaimer, the term of this patent is extended or adjusted under 35 U.S.C. 154(b) by 0 days.

(21) Appl. No.: 09/660,045

(22) Filed: Sep. 12, 2000

Related U.S. Application Data

(63) Continuation-in-part of application No. 08/980,077, filed on Nov. 26, 1997, now Pat. No. 6,126,256.

(51) Int. Cl.[7] ..... A47B 95/00

(52) U.S. Cl. ..... 312/351; 312/290; 211/74; 211/71.01

(58) Field of Search ..... 312/351, 350, 312/351.8, 128, 206, 207, 282, 311, 317.3, 290, 289; 211/74, 71.01, 78, 60.1; 248/311.3, 312, 314; 108/25, 28; D6/466, 467, 469; D7/701, 703; D24/227, 229

(56) References Cited

U.S. PATENT DOCUMENTS

| | | | |
|---|---|---|---|
| D. 168,307 | 12/1952 | Lenard | D74/13 |
| D. 234,658 | 4/1975 | Tillinger | D6/157 |
| D. 267,744 | 1/1983 | Flynn | D24/229 |
| 285,386 | 9/1883 | Burton | 211/74 |
| D. 301,670 | 6/1989 | Kennedy | D7/706 |
| D. 333,523 | 2/1993 | Gianino | D6/467 X |
| 593,312 | 11/1897 | Schandein et al. | 211/74 |
| 701,401 | 6/1902 | Schrader | 312/290 X |
| 1,659,344 | 2/1928 | Wissman | 294/143 |
| 1,730,345 | 10/1929 | Beman | 211/74 |
| 1,913,033 | 6/1933 | Kwapil | 211/74 |
| 1,996,300 | 4/1935 | Lindsay | 294/143 |
| 2,080,865 | 5/1937 | Lassiter | 108/25 X |
| 2,107,744 | 2/1938 | Solomon | 211/74 |
| 2,142,019 | 12/1938 | Warner | 248/312 |
| 2,371,433 | 3/1945 | Davis | 211/60.1 |
| 2,540,392 | 2/1951 | Haskell | 294/144 |
| 2,678,864 | 5/1954 | Louis | 108/25 X |
| 2,725,274 | 11/1955 | Stivale | 312/282 X |
| 2,899,079 | 8/1959 | Davis | 248/311.3 X |
| 2,906,412 | 9/1959 | Tanner | 211/74 |
| 3,013,852 | 12/1961 | Rockola | 312/321.5 X |

(List continued on next page.)

FOREIGN PATENT DOCUMENTS

| | | | |
|---|---|---|---|
| 1127343 | 8/1956 | (FR) | 211/74 |
| 12651 | 6/1893 | (GB) | 211/74 |
| 8986 | 5/1894 | (GB) | 211/74 |
| 8662 | 4/1896 | (GB) | 211/74 |
| 418729 | 10/1934 | (GB) | 211/74 |
| 2244205 A | 11/1991 | (GB) | 211/74 |

*Primary Examiner*—Peter M. Cuomo
*Assistant Examiner*—James O. Hansen
(74) *Attorney, Agent, or Firm*—Dowrey & Associates

(57) ABSTRACT

A storage rack for stemmed glasses and other containers having apertures with chamfered edges forming sockets for reception of the bases of inverted stemmed glasses. Access slots to the apertures are non radial with respect to the center of the apertures and are preferably tangential to the apertures. A pivotally mounted serving/mixing tray overlies the bases of the stemmed glasses to positively hold them within their sockets with positive holddowns or keeper members positioned to maintain the tray top in place. The rack may be wall mounted or adapted to be supported on a table top or the like and may be provided with carrying handles. In one embodiment, the storage rack is combined with a wine bottle rack having a cradle comprised of wedge shaped support members with contact surfaces inclined at less than 45° to the vertical. The bottles are thus supported above the surface of the shelf and the weight of the bottles themselves holds the them in tight engagement within the cradle. When combined with a portable sink and/or ice makers the bar unit becomes a self-contained installation for home, office, boat or RV use. In another embodiment, a lockable articulated security cover is mounted on the storage rack and positioned to optionally cover or uncover the beverage bottles to allow access or to prevent removal of the bottles. Slidable storage trays are also provided beneath the container support panel.

7 Claims, 7 Drawing Sheets

U.S. PATENT DOCUMENTS

| | | | |
|---|---|---|---|
| 3,039,616 | 6/1962 | Proffit | 211/74 X |
| 3,171,544 | 3/1965 | Unsworth | 248/311.2 X |
| 3,217,891 | 11/1965 | Weaver | 211/74 X |
| 3,491,893 | 1/1970 | Morris | 211/60 |
| 4,077,593 | 3/1978 | Carratala et al. | 312/351 X |
| 4,266,835 | 5/1981 | Schmidt | 312/244 |
| 4,334,623 | 6/1982 | Geary | 211/71.01 |
| 4,546,883 | 10/1985 | Youngdale | 211/74 X |
| 4,625,655 | 12/1986 | Brickman | 108/25 |
| 4,669,790 | 6/1987 | Briggs | 312/293.2 X |
| 4,700,849 | 10/1987 | Wagner | 211/71 |
| 4,842,350 | 6/1989 | Collings | 312/228 |
| 4,947,991 | 8/1990 | Snell | 206/427 |
| 5,704,495 | 1/1998 | Bale et al. | 211/71.01 |

FIG. 2
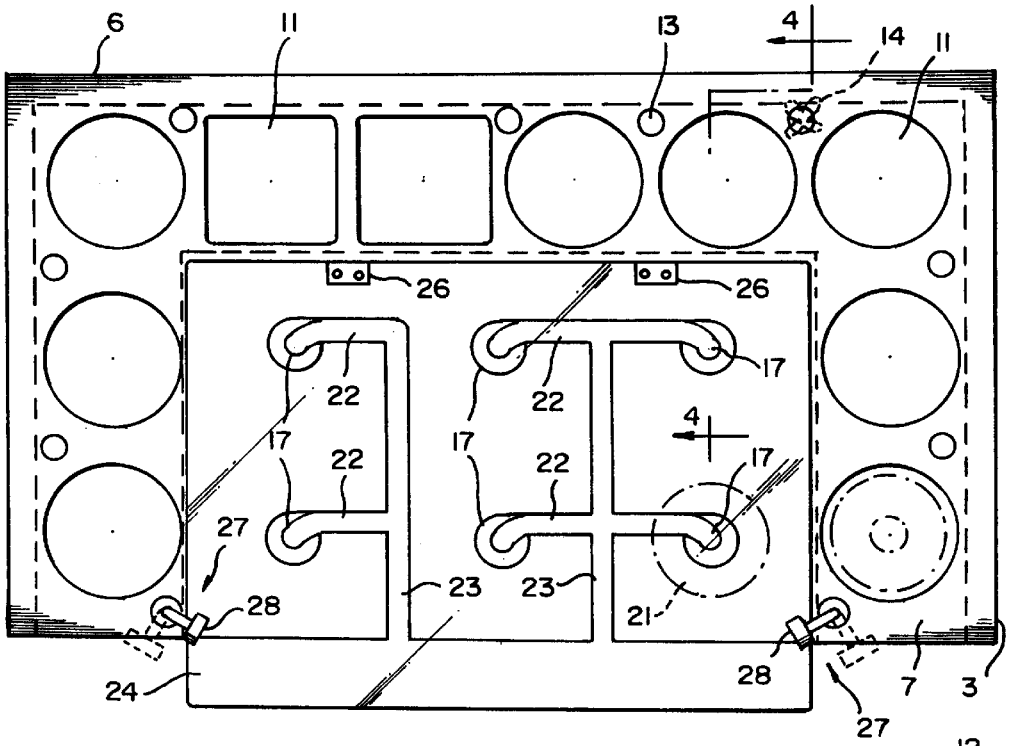
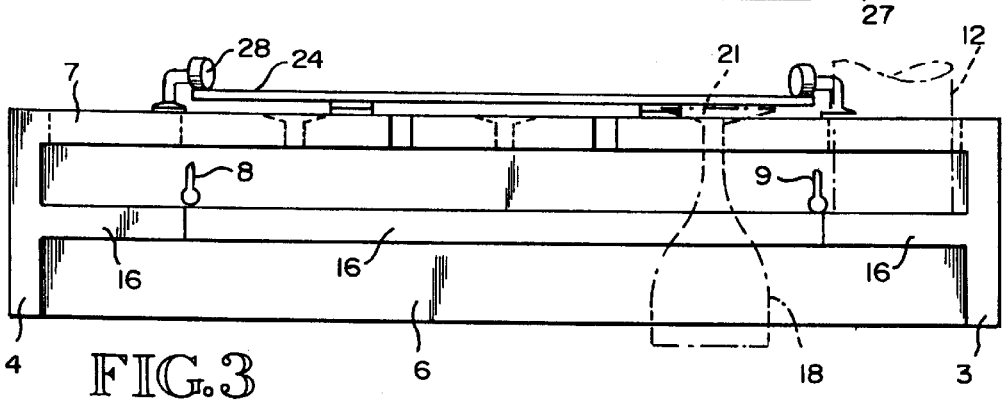
FIG. 3
FIG. 4
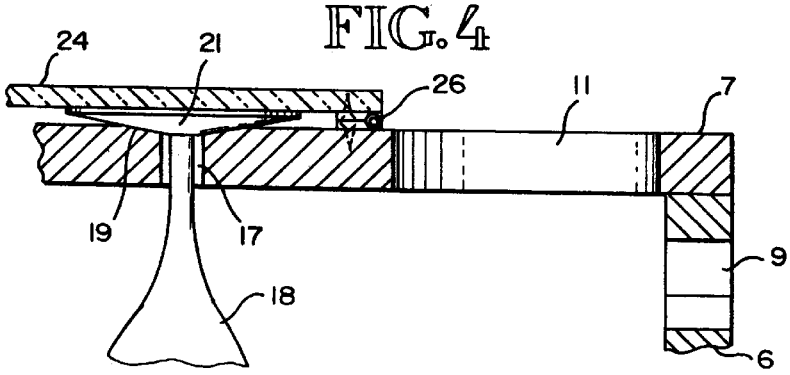
FIG. 5
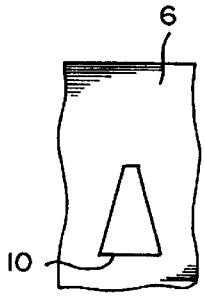

PORTABLE STEMMED GLASS/CONTAINER RETENTION RACK AND SERVING TRAY

CROSS-REFERENCES TO RELATED APPLICATIONS

This application is a continuation-in-part of U.S. application Ser. No. 08/980,077, filed on Nov. 26, 1997, now U.S. Pat. No. 6,126,256.

STATEMENT REGARDING FEDERALLY SPONSORED RESEARCH OR DEVELOPMENT

Not applicable.

REFERENCE TO A MICROFICHE APPENDIX, IF ANY

Not Applicable.

BACKGROUND OF THE INVENTION

1. Field of the Invention

The present invention relates to a portable rack for storing stemmed vessels such as glassware and other containers including beverage bottles in environments such as boats and road vehicles subject to erratic motion or vibrations. More particularly, the present invention provides a glassware rack of the character described wherein individual stemmed vessels are retained against impact with one another and/or dislodgement from the rack under adverse conditions such as experienced in small craft navigating rough water or recreational vehicles traveling on rough road surfaces. The rack of the present invention also embodies combined features such as a liquor bottle security cover and other features which particularly adapt the rack to be either wall mounted or used as a self-contained bar unit or serving tray on a support surface.

2. Description of the Prior Art

Numerous rack designs of both the wall-hanging and self-supporting type have been developed in the prior art for storing and supporting stemmed glassware and wine bottles or beverage containers. One common structure is that described in the Wagner U.S. Pat. No. 4,700,849 which comprises an overhead wine bottle rack with an arrangement of rails or slots for supporting stemmed wine glasses in the inverted position. U.S. Design Pat. No. 301,670 to Kennedy illustrates another type of stemmed glass storage unit wherein the glasses are inverted and the stem and base are held in a circular opening made accessible by a radial slot. UK Patent Application No. 2244205A and French Patent No. 1,127,343 show still further examples of devices for storing stemmed glassware and wine bottles utilizing a wire rack design. With the type of support structures described in these patents, the common problem is that the inverted stemmed ware is allowed to hang free, subject to possible damaging contact with one another if the support rack is jostled or impacted in any manner. The result, of course, is broken stemmed ware. Additionally, the slotted support arrangements, either the rail type as shown in U.S. Pat. No. 4,700,849 or the radial slot type shown in the other patents, provide no means to prevent accidental dislodging of the stemmed glassware if the unit is tilted or jarred.

In order to provide a more stable seating for the inverted stemmed ware, many wine glass racks utilize a socket or chamfered edge around the circular hole which holds the base of the stemmed glass. The following listed patents show examples of this configuration:

| | Patentee |
|---|---|
| U.S. Pat. No. | |
| 3,491,893 | Morris |
| 4,546,883 | Youngdale |
| Foreign Patent | |
| UK8986 | Morrison et al |

The chamfered opening configuration adds a certain amount of stability to the inverted stemware and improves the seating of the base of the glass against the retention opening. The use of radial slots providing access to the openings in the holder, however, permits accidental removal of the stemmed ware from the slots. While the Youngdale U.S. Pat. No. 4,546,883 provides individual enclosures or dividers between the inverted stemmed ware for shipping purposes, during normal use the glasses are allowed to freely swing with the possibility of breakage. The British Patent No. 8986 seeks to solve the problem by providing a second set of openings c which surround the glasses to prevent contact.

Another attempt at stabilizing the base-held stemmed glass units in a rack is shown in the Unsworth U.S. Pat. No. 3,171,544. This concept involves the use of a slot for admitting the base of the stemmed glass and a cushion like substance with a backup film layer which bears against the bottoms of the individual glasses to hold them in place. This approach however does not serve to isolate the glasses and prevent damaging contact in the event of any rough handling of the rack.

The following listed patents are offered as examples of serving tray structures which are designed to hold food and beverage glasses and/or containers:

| U.S. Pat. No. | Patentee |
|---|---|
| 285,386 | Burton |
| 1,996,300 | Lindsay |
| 2,080,865 | Lassiter |
| 2,540,392 | Haskell |
| 4,947,991 | Snell |

U.S. Pat. No. 1,996,300 to Lindsay and U.S. Pat. No. 2,540,392 to Haskell show devices for securing food or beverage containers to the tray structure in a storage mode. None of these devices, however, are designed for hanging inverted stemmed glassware.

None of the prior art patents discussed address the problem of stabilizing inverted stemmed glassware in an environment, such as mobile campers and trailers or marine vessels, wherein the rack is likely to be frequently jostled or tilted. In this environment, the stemmed glasses not only swing and contact each other causing breakage but are susceptible to being jarred out of their retention sockets because of the open radial access slots.

SUMMARY OF THE INVENTION

The present invention provides an improved storage rack for stemmed glass and other beverage containers which may be either wall mounted or table top supported. In one embodiment, the rack structure of the present invention provides a novel configuration of tangentially disposed access slots for the stemmed glass retention sockets. This feature alone adds stability and lessens the possibility of accidental removal of the stemmed vessels. Additionally a pivoted cover panel may be mounted on the rack structure so as to overlie the bases of the glasses in the sockets. The inverted stemmed glasses are thus further stabilized so as to prevent relative movement and possible damaging contact. The pivoted cover panel also serves as a tray surface permitting the glass/container rack to be used as a serving tray for beverages or foodstuffs. Another embodiment of the rack structure is made suitable for a self-contained bar unit with the inclusion of a wine rack. The wine rack includes novel support means wherein the bottle as well as its neck portion is tightly held in a cradle. The weight of the bottle itself serves to wedge it in the supports, secure against removal by the usual jarring, tilting or vibrations experienced in the type of environment described.

In still another embodiment, the serving tray structure includes not only a support for the stemmed glasses and other vessels but also a liquor bottle or other beverage supporting structure with a lockable bottle security cover. The security cover is carried by the container support rack portion of the structure and, when locked, prevents removal of the liquor bottles from either the table or wall mounted versions. Additionally, provision is made for removable sliding storage trays beneath the surface of the serving tray.

BRIEF DESCRIPTION OF THE DRAWINGS

FIG. 2 is a plan view of the rack and serving tray of FIG. 1;

FIG. 3 is a front elevational view of the rack and serving tray;

FIG. 4 is a cross sectional view taken along lines 4—4 of FIG. 2;

FIG. 5 is an elevational detail of a modified slot arrangement for wall mounting the rack;

DESCRIPTION OF THE PREFERRED EMBODIMENT

While the present invention is illustrated as a portable rack with particular utility in recreational vehicles or marine vessels subject to severe vibrations or severe buffeting, it will be understood that the invention is not in any way limited to these usages. For instance, the rack and serving tray combination can be installed as a permanent fixture and is well adapted for home or commercial use such as restaurants and bars. The novel retention socket and access slot configuration may also be used in stemmed glass support racks of various configurations either with or without an overlying tray top.

Figure 1:
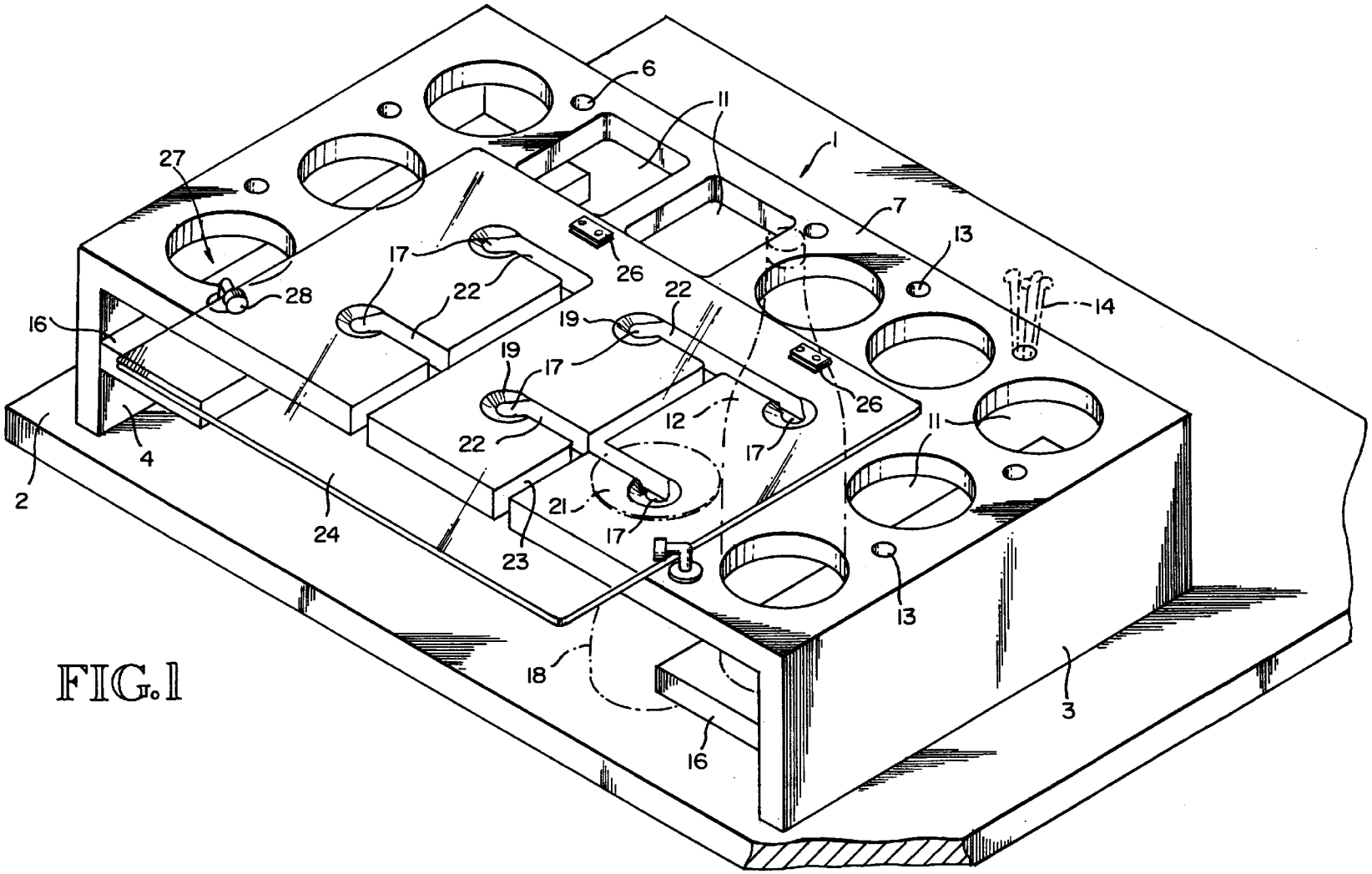
FIG. 1 is a perspective view of the portable stemmed glass container rack and serving tray positioned on a supporting surface.

FIGS. 1–5 illustrate a preferred embodiment of the invention comprising a portable unit which may be wall mounted for storage and removed for use on a table top or other support surface for serving beverages. Referring to FIG. 1, the support rack indicated generally at 1 is shown supported by a table top or other support surface 2, convenient for serving beverages or the like. The portable rack includes vertical end panels 3 and 4, a vertical rear panel 6 and a stemmed glass/container support top horizontal panel 7. The structure described forms a box like unit which may be supported on a table such as shown in FIG. 1 with the rear and end panels supporting the top panel 7 above the table surface. The forward edge of the panel 7 presents a free edge for access to the vessel retention structures presently to be described. The rear panel 6 may be provided with spaced slotted openings 8 and 9, shown in FIGS. 3 and 4, for the purpose of mounting the tray structure on a vertical wall in a well known manner. The vertical and horizontal panels of the rack may be constructed from any suitable material such as wood, plastic or metal in order to provide a rigid structure.

As seen in FIG. 1, the top horizontal panel 7 in the preferred embodiment includes a plurality of openings 11 around the rear and side peripheral edges which may be of various sizes and configurations to conveniently receive and support items such as square or round bottles 12, drinking glasses or food containers as the case may be. In addition, holes of a smaller dimension such as shown at 13 may be provided around the periphery for receiving such items as straws or swizzle sticks 14. In order to accommodate items stored in the holes 11 and 13, a horizontal ledge 16 is attached to the inside surfaces of side panels 3 and 4 and rear panel 6. The ledge thus extends about three sides of the rack structure directly beneath the holes 11 and 13 and is spaced an appropriate vertical distance in order to provide support for items contained in the openings. The ledge 16 may be constructed in any desired design but will preferably be made from the same material as the rest of the rack and supported directly from the rear and end panels in a rigid manner. With this construction, the central area of the top panel 7 remains clear for the purpose of preparing and serving food or beverages.

As seen in FIGS. 1 and 2, the central and forward area of the horizontal panel 7 is provided with a plurality of holes or apertures 17 which extend through the body of the panel. The apertures may be identical or of varying sizes but, in any case, each is designed to receive the stem of the particular stemmed glass 18 to be stored in the inverted position as shown in FIGS. 1, 3 and 4. It will also be noted that, although six such apertures are illustrated in the preferred embodiment, the exact number of storage locations and the particular pattern or arrangement of the apertures may be varied without departing from the spirit of the present invention. Each of the apertures 17 is provided with a chamfered edge 19 on the upper surface of the panel 7. The chamfered edges provide a dish-like reception area or socket for the normally tapered surface of the stemmed glass base 21 indicated in FIGS. 3 and 4. Although the chamfered edge and the socket provided acts to somewhat stabilize the hanging glass, it does not prevent swinging motion of the glasses in the event the rack is tilted or jarred. In practice, the diameter of the chamfered edge and socket may be varied to accommodate any specific stemmed glass base.

Each of the apertures 17 is also provided with an associated access slot 22 which may be of approximately the same width as the diameter of the aperture 17 so as to allow passage of the glass stems. The slots 22 are positioned so as to be non-radial with respect to the circular holes 17. It is preferable to locate one side of the slot 22 substantially tangential to the aperture 17. The other side may be tangential with the circular periphery of the chamfered edge 19 depending of course on the diameter of the chamfered edge. With this arrangement, simply tilting the rack in the direction of the access slots will not dislodge the glass stems as would otherwise be the case if the slots are made radial with respect to the holes. This feature alone adds stability to the vessels. The chamfered sockets 19, of course, have a tendency to hold the glass base against removal simply because the diameter of the dished area or socket is greater than the diameter of the associated aperture. If the access slot is positioned radially with respect to the aperture, however, any vertical jarring will raise the glass base out of the socket allowing the stem to slide out of the access slot. With the use of the non radial access slots of the present invention, it will be seen that it would take a compound motion of the glass stem in order to dislodge it from the aperture. The rack would not only have to be tilted but the glass base would have to be elevated out of the socket and then moved laterally in order to pass out of the access slot. In addition to the unlikelihood of jarring the stemmed glasses from the apertures and the slots 22, each of the slots 22 in the present embodiment opens into a feeder slot 23 rather than to the open front or free edge of the panel 7. Accidental removal of the stemmed glass form the rack would therefor require a tilting of the rack, a lifting of the glass from the retention socket and movement in at least three different directions in order to be dislodged.

According to the present invention, an even more positive means for holding the inverted stemmed glasses in their sockets under the most severe jostling, tilting or mechanical vibrations is provided. For this purpose, a hinged serving tray top 24 is mounted on the horizontal panel 7 and overlies all of the retention sockets 19. The tray top 24 may be varied in size but preferably occupies substantially the entire central area of the panel 7 except for the storage openings 11. The tray top 24 may be hinged as at 26 in any conventional manner so as to allow sufficient clearance to rest on top of the glass bases 21 when in the lowered position as shown most clearly in FIG. 4. The tray top 24 may thus be raised to allow removal of the stemmed glasses 18 and lowered to positively hold the glass bases in their respective sockets. The tray top 24 may be extended a short distance beyond the front or free edge of the panel 7 for ease of operation and pivoted stop members or keepers 27 may be used to positively hold the tray top in the lowered position. As seen in FIG. 2, the stop members include a pivot post with a contact element 28 carried by the outer end for contacting the tray. The elements 28 may comprise a resilient material to avoid marring the tray surface. As shown in FIG. 2, the keepers may be pivoted between a position overlying the edges of the tray and a release position to allow raising of the tray. Although the serving tray 24 is illustrated as a transparent panel such as glass or plastic, in the alternative, it may be made from any suitable material and may be varied in shape and design for aesthetic purposes. In any event, when the tray top 24 is lowered and held in position by the keepers 27, the stemmed glasses 18 are positively held in position eliminating any danger of swinging and contacting one another or being jarred out of their sockets.

FIG. 5 illustrates an alternate slotting arrangement for mounting the rack to a wall surface. In the FIG. 5 embodiment the opening in the rear panel 6 is essentially triangular in shape having one side of the triangle forming the broad base 10 with the apex of the triangle located at the top. It will be understood that the alternate wall attaching opening of FIG. 5 functions in a conventional manner as is true with the slotted openings 8 and 9 shown in FIGS. 3 and 4.

Figure 6:
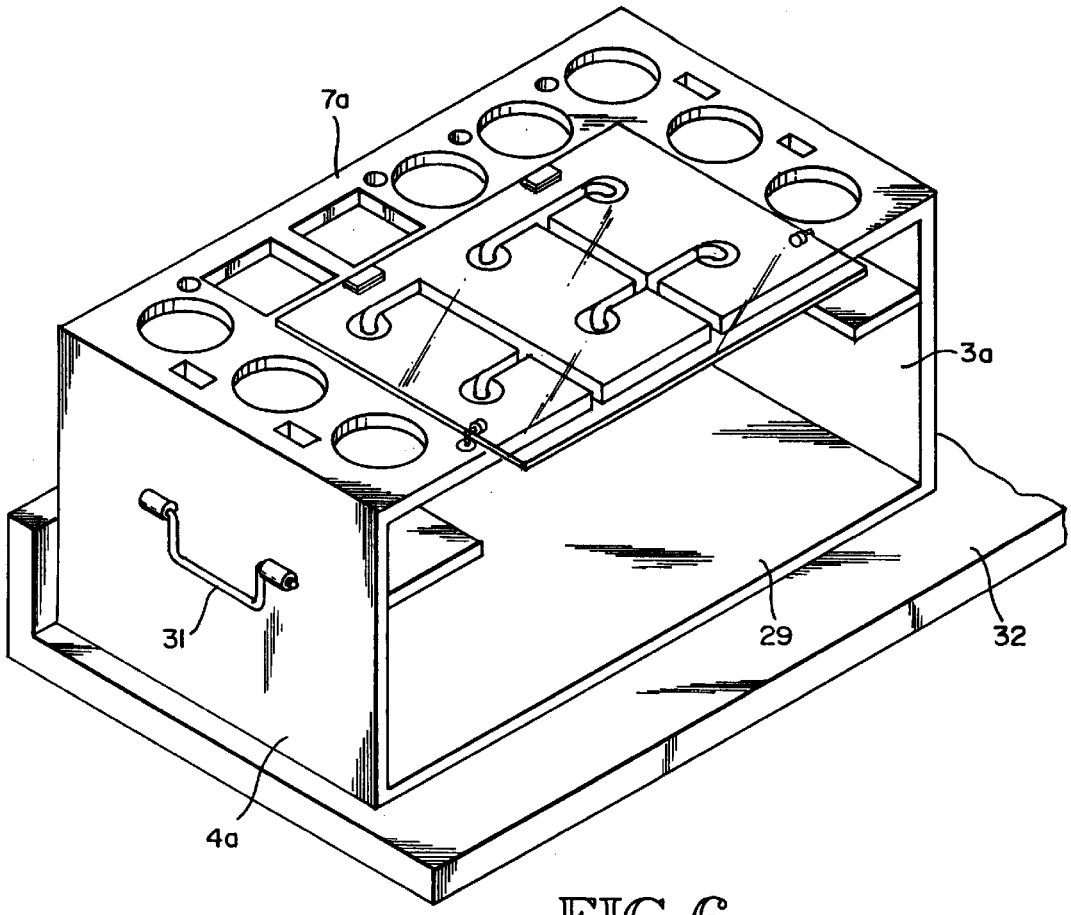
FIG. 6 is a perspective view showing a modification of the rack and serving tray adapted for counter top storage with carrying handles.
Figure 7:
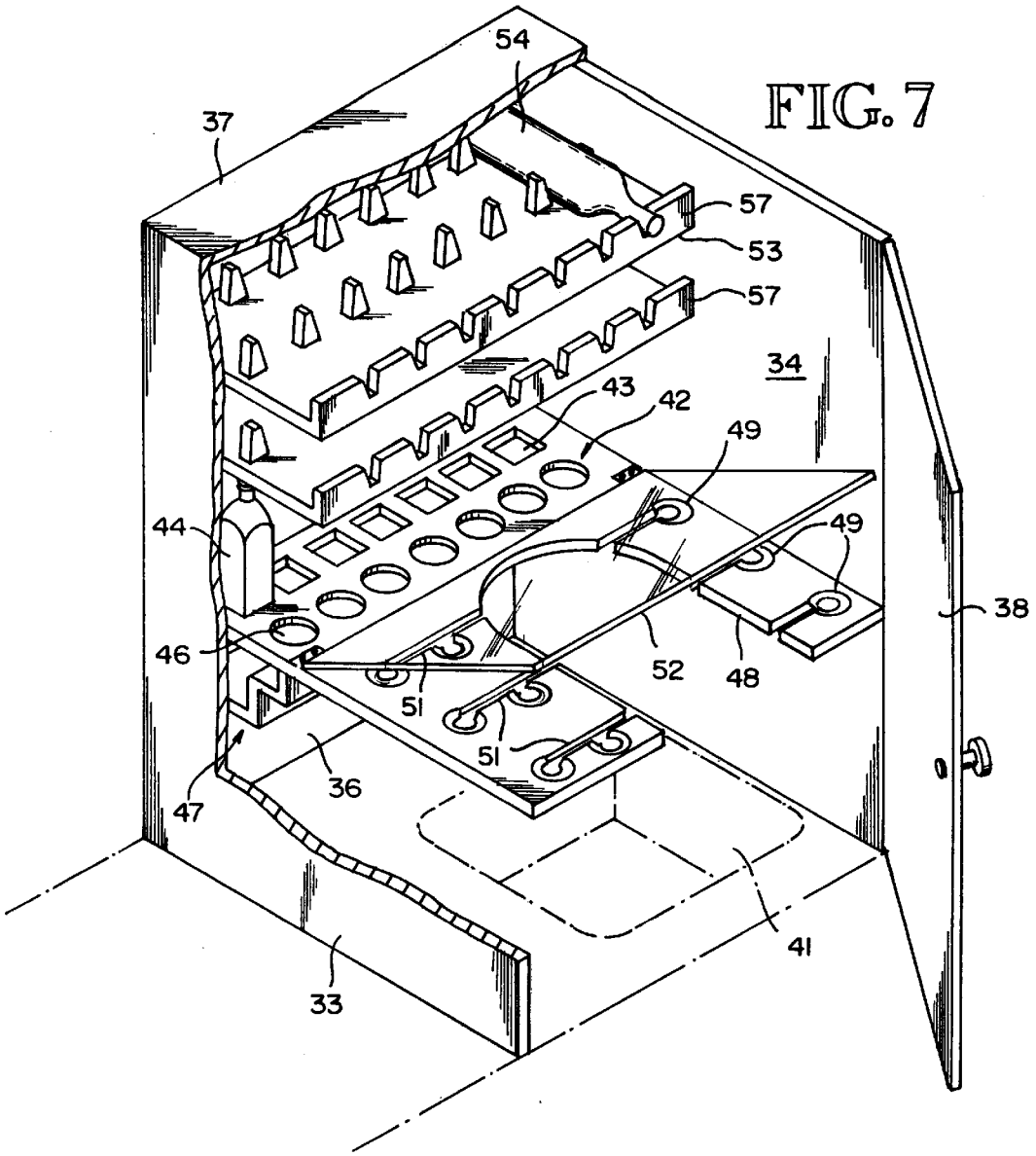
FIG. 7 is a perspective view of a modification of the rack and tray with a wine storage unit.

FIG. 6 illustrates a modification of the combined rack and serving tray suitable for shelf or table top storage rather than wall mounting. It will be understood that the pivoted tray top and stemmed glass retention features described for the FIG. 1 embodiment also apply to the modified structure of FIG. 6. As illustrated, the side walls 3*a* and 4*a* as well as the rear panel of the rack are extended to provide additional space beneath the horizontal top panel 7*a*. The structure is also provided with a bottom panel 29 so that additional items may be stored and carried in the rack beneath the tray top. Carrying handles 31 of any conventional design may also be mounted on the side panels 3*a* and 4*a* for carrying the rack. The modified rack and serving tray may be conveniently stored on a shelf or other supporting surface 32 and moved to any location for serving.

FIGS. 7–10 illustrate a further embodiment of the invention wherein the stemmed glass rack is combined with a service tray and a novel wine bottle storage structure. The combined units may be housed in a rectangular cabinet structure having side panels 33 and 34, a rear panel 36 and top wall 37. The cabinet thus assembled may be provided with a lockable door or doors 38 as illustrated to secure the contents of the cabinet. The bottom of the cabinet remains open, however, for the purpose of utilizing a conventional countertop sink such as shown at 41. The sink 41 may be an existing home, office or recreational vehicle sink as the case may be. A container storage and mixing shelf 42 is located within the cabinet structure and carried by the side and rear panels of the cabinet. The shelf 42 will be positioned at a level within the cabinet so as to leave room beneath for access to the sink 41. The shelf 42 includes a plurality of openings 43 along its rear edge for upright placement of such items as beverage bottles 44, either square or round, and an adjacent row of circular openings 46 which may be utilized for drinking glasses or tumblers. In order to support the bottles and glasses from beneath, a stepped shelf 47 extends between the walls 33 and 34 and may be supported from the bottom of the shelf 42 and the back wall 36.

The forward portion of the shelf 42 is provided with, in this case, a u-shaped cut-out area indicated at 48 which may be located so as to provide access for removal of stemmed glasses and use of the sink 41. A plurality of stemmed glass retention structures are located on the surface of the shelf 42 about the central cut-out 48. In the present embodiment, three such glass retention structures 49 are shown on one side of the shelf while three sets of tandem support structures 51 are shown on the opposite side. These structures may be similar or identical to the retention structures shown in the FIGS. 1 and 2 embodiment and will include apertures in the shelf for the reception of glass stems, chamfered sockets about the apertures and tangential access slots. In this embodiment the access slots open into the cut-out area 48. A pivoted tray top 52 is hinge mounted on the top surface of the shelf 42 in the same manner as described for the serving tray top 24 of the FIG. 1 embodiment. In this embodiment, the pivoted tray 52 is used for mixing or pouring drinks.

Figure 8:
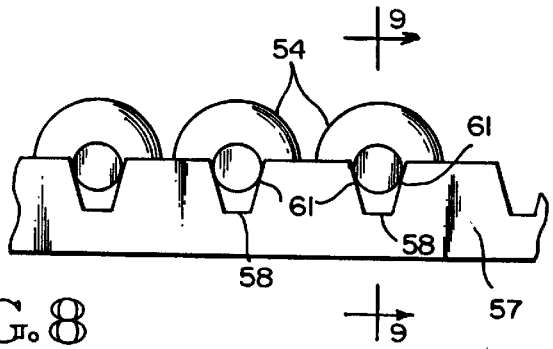
FIG. 8 is a front elevational detail of a portion of the wine bottle storage unit.
Figure 9:
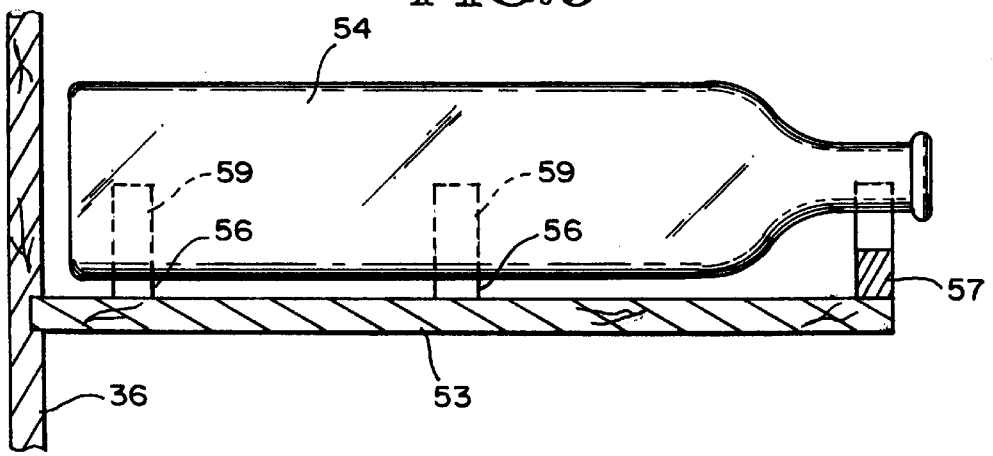
FIG. 9 is a cross sectional view taken along lines 9—9 of FIG. 8.

One or more wine or other beverage bottle storage shelves 53 are mounted between the side panels 33 and 34 directly above the storage shelf 42 and located to the rear of the cabinet. These shelves may be identical with the number of shelves utilized being a matter of choice. Each shelf 53 is designed to store a plurality of bottles 54 in parallel substantially horizontal position. In the present illustrated embodiment individual wine bottles are cradled in their storage position by means of a pair of longitudinally spaced wedge shaped supports 56 on each side. The neck of the bottle is supported by a front rail 57 attached to the forward edge of the associated shelf 53. Wedge shaped notches or slots 58 are formed in the top edge of the rail and designed to receive the neck of the bottle as shown in FIG. 8. According to the present invention the wine bottles are suspended above the shelf 53 and the necks of the bottles do not contact the bottom of the associated notches 58 in the rail 57. The pairs of wedge-shaped supports 56 have opposing inclined faces 59 which do not permit the bottle to contact the underlying shelf 53. The angles of the inclined surfaces 59 are chosen so that the bottle is actually wedged between the supports by its own weight. In order to accomplish this, the surfaces 59 are preferably inclined at an angle less than 450 to the vertical. Likewise, the opposing inclined surfaces 61 of the notches 58 are inclined at an angle less than 450 to the vertical so as to actually wedge the neck of the bottle above the bottom of the notch. This arrangement serves to hold the bottles tight in their cradles with total support being provided by the supports 56 and notches 58. Thus, the likelihood of dislodgement of the bottles is avoided if the cabinet is moved or is utilized under circumstances where jostling or vibrations are encountered.

Figure 10:
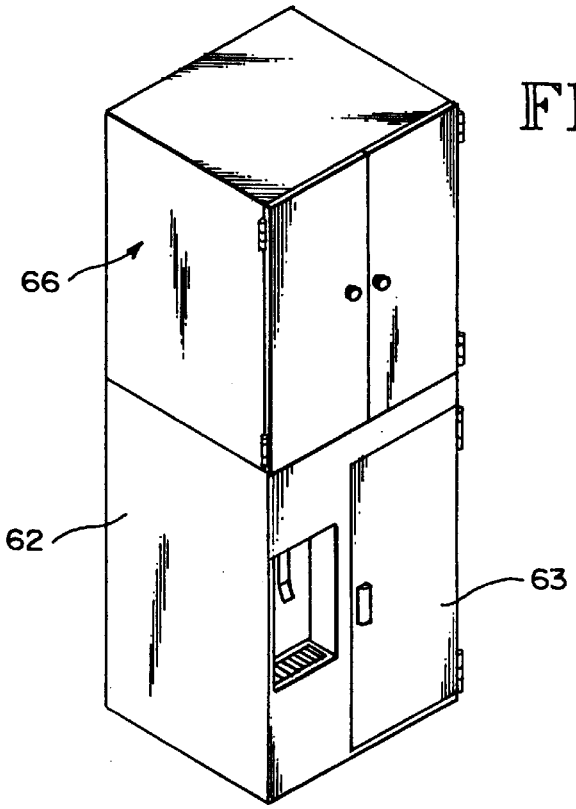
FIG. 10 is a perspective view of the FIG. 7 embodiment combined with a self-contained sink and ice maker.

The bar unit of the type described may be utilized with an existing sink or be combined with other features such as a self-contained sink or ice maker as shown in FIG. 10. The FIG. 10 embodiment shows a double-doored storage rack and mixing tray 66 which may in all respects be identical to the FIG. 7 embodiment mounted integral with or detachable from an ice maker 62 and a wet or dry sink 63. Installations of this type are convenient for use in large yachts or cross country recreational vehicles and especially adaptable for office environments.

Figure 11:
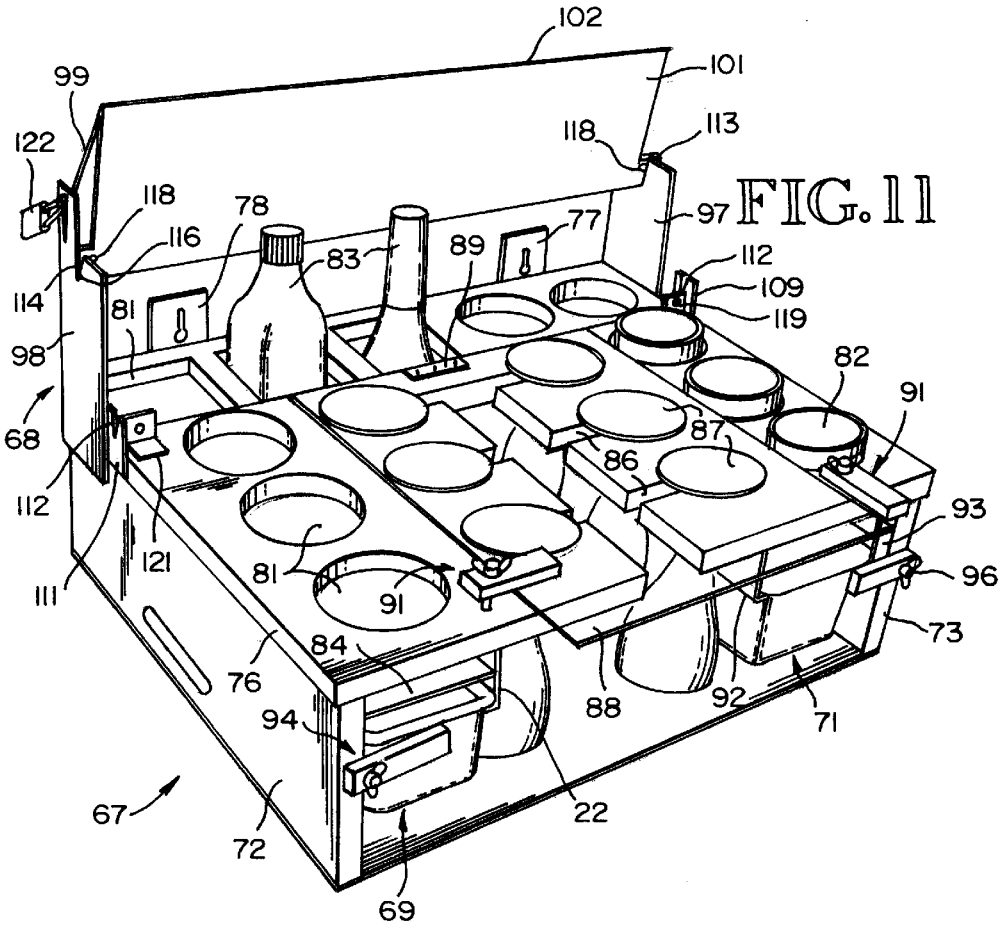
FIG. 11 is a perspective view of a portable stemmed glass container rack and serving tray including the lockable bottle security cover in the open position and sliding storage trays beneath the serving tray surface.
Figure 12:
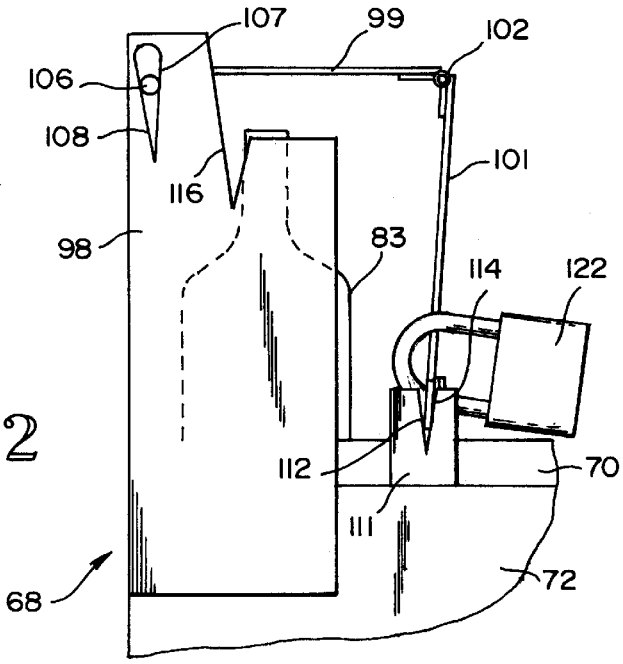
FIG. 12 is a partial end elevation of the rack and serving tray of FIG. 11 with the bottle security cover in the closed position.
Figure 13:
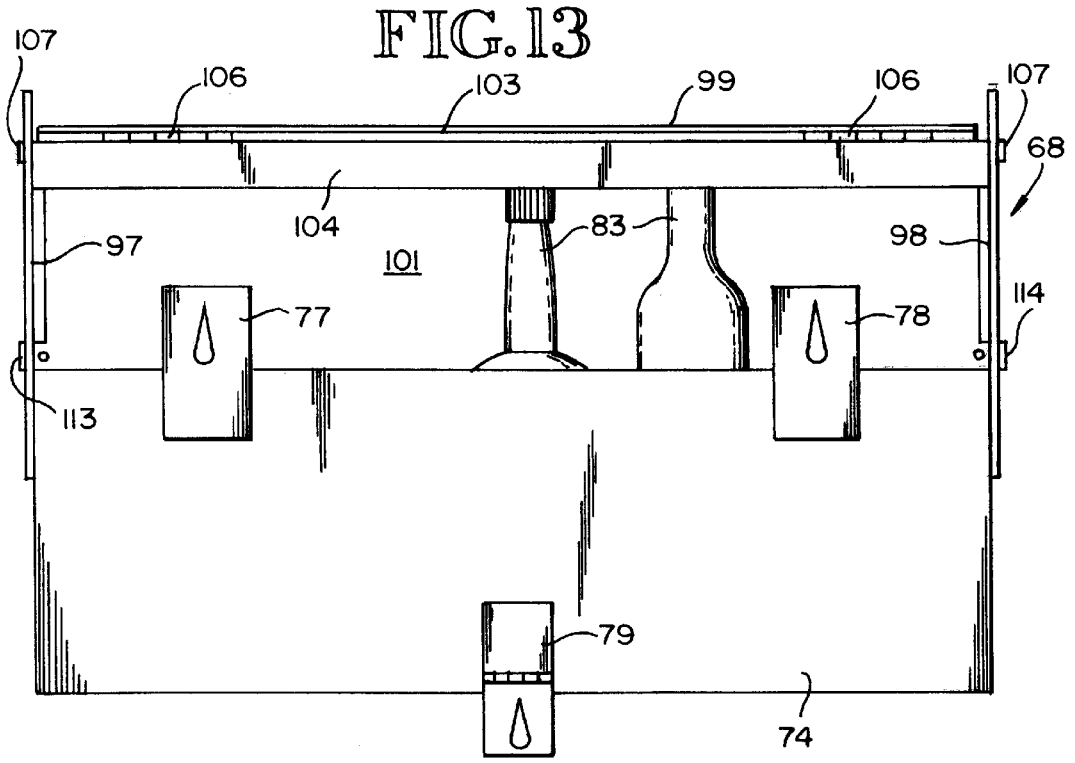
FIG. 13 is a rear elevational view of the container rack and serving tray of FIG. 11 with the bottle security cover in the closed position.

FIGS. 11–13 illustrate still another embodiment of the combined rack and serving tray suitable for either table top or wall mounting which includes a novel lockable bottle security cover. The basic structure of the support rack indicated generally 67 in FIG. 11 may be identical or substantially similar to the support rack of FIGS. 1–5 with the addition of the security cover 68 and the right and left hand slidable storage trays 69 and 71 respectively. As with the FIGS. 1–5 embodiment, the portable rack includes the vertical end panels 72 and 73, a vertical rear panel 74 and a stemmed glass/container support top horizontal panel 76. The structure described forms a boxlike unit which may be supported on a table or which may be mounted on a vertical wall by means of the optional support brackets 77–79 as shown in FIG. 13. The brackets 77–79 may take any desired configuration and will either be made as an integral part of the rear panel 74 or be attached thereto by means such as screw fasteners or welding in the event of a metal construction. It will also be understood that such support means may be made in the form of the slotted openings as shown in the FIGS. 1–5 embodiment. The bracket 79 may be made in the form of a hinged plate as shown in FIG. 13 for the purpose of folding upwardly so as not to obstruct the seating of the support rack on a horizontal surface. Each of the brackets 77–79 will include a slotted opening similar to the FIG. 5 embodiment with the opening having a generally triangular shape with a broad base and the apex of the triangle located at the top of the opening. This configuration serves to insure a secure engagement with a mounting screws or other attaching means secured to a wall.

It will be understood that the top support panel 76 may include a plurality of openings such as the openings 81 along the sides and rear edges of the panel for receiving such items as glasses 82 and beverage bottles 83 along the rear edge. These items will be supported from beneath by support panels 84 as previously described relative to the FIGS. 1–5 embodiment, with these supports being located directly beneath the holes 81 as illustrated. The rear openings 81 will normally be designed to accommodate alcoholic beverages for which the security cover, presently to be described, is designed to prevent unwanted removal.

As previously described relative the FIGS. 1–5 embodiment, the top support panel is designed to include the circular openings with access slots 86 for receiving and seating the base portions of stemmed glassware and it will be understood that the slotting arrangement and openings may be substantially the same as described for FIGS. 1–5 or the alternate embodiments illustrated. The base portions 87 of the inverted stemmed glassware will be securely held in place by a pivoted tray top 88, which in the present embodiment, is illustrated as a transparent plastic or glass panel. It will be understood, of course, that the cover 88 may be made of any suitable material and is designed to securely hold the stemmed glassware against substantial movement when the support rack is moved or jostled. As with the FIGS. 1–5 embodiment, the pivoted tray top 88 may be hinged by means such as the hinge 89 at the rear edge to the support panel 76. The tray top 88 is held in place by means of the pivoted keepers 91 which hold the pivoted tray top in the lowered position. Although the keeper means illustrated is in the form of a pivoted latch or stop mounted on vertical posts attached to the support panel, it will be understood that any suitable keeper pivoted on the support panel 76 may be utilized. For instance, a latch could be mounted on the tray top itself and designed to engage an element on the support panel or vice versa and may take any form or configuration known in the art as long as it serves to hold the tray in the lowered position relative to the support panel. Other means such as magnetic strips or mechanical detents of any type acting between the support panel and the tray will also suffice to perform the function. In some installations a simple spring bias holding the tray in the lowered position or the weight of the tray itself will suffice and it is to be understood that the present invention is not limited to the use of any particular keeper means.

In the present embodiment, the slidable storage trays 69 and 71 are carried by suitable sets if support rails 92 and 93 extending downwardly from the panel 76. The trays 69 and 71 may be of any type such as well known commercially available plastic containers with suitable peripheral rims for support. The trays 69 and 71 may be restrained from sliding out of their supports by means of the keepers 94 and 96 carried by the side panels 72 and 73 respectively. As with the keepers 91, the structural details of these keepers 94–96 may be varied as desired and the present invention is not limited to any particular type of keeper.

The security cover 68 includes the right and left hood support brackets 97 and 98 respectively which, in the present embodiment, are attached or fixed to the side panels 73 and 72 respectively of the tray rack. It will be understood, of course, that these support brackets 97 and 98 may be made integral with the side panels 72 and 73, may be attached thereto by screw threaded fasteners or, in the instance of metal panels, may be welded or otherwise attached to the side panels. Any such configuration is well within the spirit and scope of the present invention. It would also be possible, of course, to configure the brackets 97 and 98 to be attached to the rear panel 74 of the tray rack. The security cover further includes the articulated hinged panels 99 and 101 which prevent removal of the bottles 83 from the wells in which they are seated. The panels 99 and 101 may be formed from sheet metal or plastic or any other suitable material and are connected along their adjacent edges by means of the hinge 102 which allows the panels to move from the closed or covering position shown in FIG. 12 to the raised position shown in FIG. 11. The rear edge 103 of the top panel 99 is connected to a cross bar 104 by means of the hinges 106 which may be either in the form of separate hinges as shown in FIG. 13 or continuous hinge such as a piano hinge well known in the art. The cross bar 104 may be made of a rigid material such as heavy plastic or metal and serves as a stiffener for mounting the articulated hood panels 99 and 101. The ends of the cross bar 104 include protrusions 107 which extend through the triangular shaped slots 108 and each of the side panels 97 and 98 shown clearly in FIG. 12. The slots 108 in the illustrated embodiment are V-shaped with the apex of the triangle on the bottom end to allow the protrusions 107 to seat securely in the support brackets 97 and 98.

An additional set of seating brackets 109 and 111 are attached to the top support panel 76 slightly forward of the brackets 97 and 98. In the alternative the brackets may be attached to the side panels 72 and 73. The seating brackets may be made of any suitable material and include elongated V-shaped notches 112 for seating the end tabs 113 and 114 on the lower edge of the cover panel 101 as shown in FIG. 12. The V-shaped notches 112 serves to tightly grip the bottom edges of the tabs 113 and 114 when the articulated cover is in the closed position shown in FIG. 12. The hood support brackets 97 and 98 both include a V-shaped notch 116 for receiving and supporting the articulated hood in the open position as shown in FIG. 11 in the same manner. In order to provide for locking the security cover in the closed position shown in FIG. 12, each of the tabs 113 and 114 is provided with a hole or opening 118 and locking brackets 119 and 121 are mounted on the surface of the support panel 76 adjacent the seating brackets 109 and 111. The locking brackets are also provided with suitable holes or openings which match with the holes 118 in the tabs of the panel 101 when the cover is in the closed position shown in FIG. 12 to permit a locking means, such as the padlock 122, to be engaged to hold the security cover in the closed position. Although one padlock may suffice, it is possible to lock both ends of the security cover to avoid disengagement of the cover. The locks 122 may be stored in the slots 108 as shown in FIG. 11 when the security cover is in the opened position.

With the arrangement described and illustrated, the security cover may normally be positioned in the raised or open position shown in FIG. 11 when the glass rack and serving tray are in use. In the raised position, access to the bottles such as liquor bottles 83 is permitted, allowing the bottles to be freely removed from the wells 81. When it is desired to close the bar and to prevent removal of the liquor bottles, the articulated cover is moved to the closed position as shown in FIG. 12 with the front panel 101 being locked in position with such means as a padlock 122. As shown in FIG. 12, when the cover is in the closed position, it is impossible to remove the bottle 83 upwardly and outwardly from the wells 81 even from the back side. Alternative locking devices, either keyed or combination type, which may be either removable or permanently mounted on the support panel 76 or the hood panel itself, may be utilized to secure the front panel 101 in the closed position. It is to be understood that the present invention is not limited to the particular type of locking device for securing the panel 101 in the closed position.

It will be understood that the foregoing description and accompanying drawings have been given by way of illustration and example. It is also to be understood that changes in form of the several parts, substitution of equivalent elements, arrangement of parts, and substitution of equivalent materials, which will be readily apparent to one skilled in the art, are contemplated as being within the scope of the present invention, which is limited only to the claims which follow.

What is claimed is:

1. A vessel retention rack comprising;

a substantially planar panel having a top support surface, at least one aperture in said panel adapted to contain a vessel stem, said aperture having a center point and a chamfered peripheral edge in the support surface forming a socket for reception of a surface of a vessel having its stem extending through said aperture, a non radial access slot in said panel communicating with said aperture to permit lateral insertion of a vessel stem therein, the slot and the aperture meeting at a junction, the slot having substantially parallel side edges and a centerline offset from the center point of said aperture at the junction thereof, a tray panel pivotally mounted on said top support surface for movement between a lowered position overlying the base of the vessel for positive retention of said vessel and a raised position allowing access for removal thereof, keeper mechanism for positively holding said tray panel in the lowered position, said panel including beverage bottle retention means along one edge of the top surface thereof, an articulated security cover carried on said rack having a closed position overlying beverage bottles located in said bottle retention means to prevent removal thereof and an open position permitting access to said bottles, and locking means to selectively lock said cover in the closed position.

2. A stemmed vessel retention rack comprising;

a substantially planar panel having a top surface having at least one substantially linear free edge for vessel insertion, a plurality of apertures in said panel, each aperture adapted to contain a vessel stem, said aperture having a center point and a circular chamfered peripheral edge in the support surface forming a socket for reception of a surface of a vessel having its stem extending through said aperture, a plurality of access slots in said panel in spaced relation with said slots intersecting said apertures to permit lateral insertion of a vessel stem therein, the slots each having a longitudinal axis offset from the center point of its associated aperture and a side that is substantially tangent to said aperture, at least one feeder slot in said panel opening into said free edge at right angles thereto, each said access slot opening into said feeder slot at right angles thereto, said panel including beverage bottle retention means along one edge of the top surface thereof, an articulated security cover carried on said rack having a closed position overlying beverage bottles located in said bottle retention means to prevent removal thereof and an open position permitting access to said bottles, and locking means to selectively lock said cover in the closed position.

3. A combination serving tray and storage rack for storing vessels having a container bowl, a generally flat support base and an elongated stem extending therebetween, comprising;

a support panel having a top surface with at least one aperture therein, said aperture including a chamfered peripheral edge forming a socket adapted to receive and retain the stem of an inverted stemmed vessel having its stem extending through the aperture with the support base thereof seated in said socket, an aperture access slot communicating with said aperture for permitting lateral insertion of a vessel stem into said aperture, a tray panel pivotally mounted on said top support surface for movement between a lowered position adapted to overlie and contact the support base of a vessel when seated in said socket for positive retention thereof and a raised position allowing access for removal thereof, keeper mechanism for positively holding said tray panel in the lowered position, said panel including beverage bottle retention means along one edge of the top surface thereof, an articulated security cover carried on said rack having a closed position overlying beverage bottles located in said bottle retention means to prevent removal thereof and an open position permitting access to said bottles, and locking means to selectively lock said cover in the closed position.

4. The combination of claim 3 wherein said beverage bottle retention means supports beverage bottles in an aligned row having a front side adjacent said at least one aperture and a rear side adjacent said one edge of the support panel, said articulated security cover comprising;

a first cover panel including a rear edge and a front edge extending along the length of said row of bottles, a second cover panel having a front edge and a rear edge hingedly connected to the front edge of said first cover panel, said articulated security cover having a closed position with the first panel overlying said bottles and the second cover panel extending in front of said bottles to prevent removal thereof, and an open position with said panels in an upwardly folded position permitting access to the row of bottles, first bracket means extending upwardly from said support panel and including a cross bar hingedly connected to the rear edge of said first panel, said first bracket means including first engagement means for supporting the front edge of said second panel in the upwardly folded open position, and second engagement means for supporting the opposite ends of said second panel at the front edge thereof in the closed position.

5. The combination of claim 4 wherein said locking means comprises;

through openings in the opposite ends of said second cover panel adjacent the front edge thereof, upstanding locking brackets fixed to the surface of said support panel, said locking brackets including through openings aligned with the through openings in said second cover panel when in the closed position, and a selectively lockable element extending into said openings to selectively secure the security cover in the closed position.

6. A vessel retention rack comprising;

a support surface having a first area including drinking vessel support means, a second area on said support surface adjacent said first area for supporting beverage bottles in an aligned row along one edge of said support surface, said row of bottles having a front side adjacent said first area and a rear side adjacent said one edge of the support surface, a security cover for said bottles comprising;

a first cover panel including a rear edge and a front edge extending along the length of said row of bottles, a second cover panel having a front edge and a rear edged hingedly connected to the front edge of said first cover panel, said first and second cover panels comprising an articulated cover having a closed position with the first panel overlying said bottles and the second cover panel extending in front of said bottles to prevent removal thereof, and an open position with said panels in an upwardly folded position permitting access to the row of bottles, first bracket means extending upwardly from said support surface and including a cross bar hingedly connected to the rear edge of said first panel, said first bracket means including first engagement means for supporting the front edge of said second panel in the upwardly folded open position, and second engagement means for supporting the opposite ends of said second panel at the front edge thereof in the closed position.

7. The vessel retention rack of claim 6 wherein said locking means comprises;

through openings in the opposite ends of said second cover panel adjacent the front edge thereof, upstanding locking brackets fixed to the support surface, said locking brackets including through openings aligned with the through openings in said second cover panel when in the closed position, and a selectively lockable element extending into said openings to selectively secure the security cover in the closed position.

* * * * *